US011384577B2

(12) United States Patent
Hammerer et al.

(10) Patent No.: US 11,384,577 B2
(45) Date of Patent: Jul. 12, 2022

(54) FURNITURE FITTING

(71) Applicant: Julius Blum GmbH, Hoechst (AT)

(72) Inventors: André Hammerer, Alberschwende (AT); Irmela Mara Geller, Dornbirn (AT); Thomas Folie, Dornbirn (AT); Matthias Reissig, Lindau (DE)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/139,244

(22) Filed: Dec. 31, 2020

(65) Prior Publication Data

US 2021/0123275 A1 Apr. 29, 2021

Related U.S. Application Data

(63) Continuation of application No. PCT/AT2019/060155, filed on May 8, 2019.

(30) Foreign Application Priority Data

Jul. 3, 2018 (AT) ..... A 50575/2018

(51) Int. Cl.
*E05D 7/04* (2006.01)

(52) U.S. Cl.
CPC ..... *E05D 7/0407* (2013.01); *E05D 7/0415* (2013.01); *E05D 2007/0461* (2013.01);
(Continued)

(58) Field of Classification Search
CPC ..... E05D 7/0407; E05D 7/0415; E05D 2007/0461; E05D 2007/0476;
(Continued)

(56) References Cited

U.S. PATENT DOCUMENTS 3,977,042 A * 8/1976 Lautenschlaeger ... E05D 7/0407 16/238
4,620,343 A * 11/1986 Grass ..... E05D 7/0407 16/236

(Continued)

FOREIGN PATENT DOCUMENTS

AT 388 016 4/1989
CN 105683472 6/2016

(Continued)

OTHER PUBLICATIONS

Espacenet machine translation of CN206829871U, Jan. 2018 (Year: 2018).*

(Continued)

*Primary Examiner* — Jeffrey O'Brien
(74) *Attorney, Agent, or Firm* — Wenderoth, Lind & Ponack, L.L.P.

(57) ABSTRACT

A furniture fitting includes a first fitting portion to be fixed to a furniture carcass, and a second fitting portion to be fixed to a movable furniture part and hingedly or releasably connected to the first fitting portion. The first fitting portion includes a mounting body for fixing to the furniture carcass, and a carrier configured to adjust a position of the carrier relative to the mounting body. An actuating arm is pivotally arranged on the carrier, and a spring device applies a force to the actuating arm. An adjustment device with three operating elements is provided, and a position of the carrier relative to the mounting body can be adjusted by the operating elements. The mounting body includes a fastening side for fixing the mounting body to a furniture panel. Each of the operating elements is configured to be actuated from the front side of the mounting body.

18 Claims, 5 Drawing Sheets

(52) U.S. Cl.
CPC ..... *E05D 2007/0476* (2013.01); *E05D 2007/0484* (2013.01); *E05D 2007/0492* (2013.01); *E05Y 2600/41* (2013.01); *E05Y 2900/20* (2013.01)

(58) Field of Classification Search
CPC .... E05D 2007/0484; E05D 2007/0492; E05D 3/14; E05D 3/142; E05F 1/1246
See application file for complete search history.

(56) References Cited

U.S. PATENT DOCUMENTS

| | | | | |
|---|---|---|---|---|
| 6,829,808 | B2 * | 12/2004 | Neukotter | E05D 3/186 16/366 |
| 8,881,346 | B2 | 11/2014 | Oshima et al. | |
| 9,169,681 | B2 * | 10/2015 | Cooper | E05F 5/006 |
| 9,605,457 | B2 | 3/2017 | Humble | |
| 9,663,979 | B2 * | 5/2017 | Dreisewerd | E05D 7/0415 |
| 9,822,564 | B2 * | 11/2017 | Dreisewerd | E05D 5/02 |
| 9,909,346 | B2 | 3/2018 | Holzapfel | |
| 9,976,327 | B2 * | 5/2018 | Dreisewerd | E05D 3/186 |
| 10,240,377 | B2 * | 3/2019 | Arai | E05D 7/0415 |
| 10,407,963 | B2 * | 9/2019 | Salice | E05F 1/1253 |
| 10,494,845 | B2 * | 12/2019 | Yamaguchi | E05D 3/186 |
| 10,767,407 | B2 * | 9/2020 | Salice | E05D 3/142 |
| 2002/0073509 | A1 * | 6/2002 | Dean | E05D 7/0415 16/387 |
| 2013/0219659 | A1 | 8/2013 | Oshima et al. | |
| 2016/0168896 | A1 | 6/2016 | Holzapfel | |
| 2016/0208532 | A1 | 7/2016 | Humble | |
| 2016/0281403 | A1 | 9/2016 | Arai | |
| 2017/0130497 | A1 * | 5/2017 | Yamaguchi | E05D 3/186 |
| 2017/0198507 | A1 | 7/2017 | Humble et al. | |
| 2018/0252016 | A1 | 9/2018 | Salice | |
| 2019/0071908 | A1 | 3/2019 | Salice | |
| 2021/0087867 | A1 * | 3/2021 | Folie | E05D 7/125 |
| 2021/0115714 | A1 * | 4/2021 | Duer | E05D 3/142 |
| 2021/0189780 | A1 * | 6/2021 | Nordieker | E05D 7/0423 |

FOREIGN PATENT DOCUMENTS

| | | |
|---|---|---|
| CN | 107083888 | 8/2017 |
| CN | 107269143 | 10/2017 |
| CN | 206829871 | 1/2018 |
| CN | 206829871 U * | 1/2018 |
| CN | 108166899 | 6/2018 |
| DE | 196 37 081 | 3/1998 |
| DE | 20 2012 009 218 | 3/2013 |
| EP | 2 853 667 | 4/2015 |
| EP | 3 070 241 | 9/2016 |
| JP | 55-42993 | 3/1980 |
| JP | 2015-229864 | 12/2015 |
| JP | 2018-514670 | 6/2018 |
| WO | 2008/135023 | 11/2008 |
| WO | 2012/057249 | 5/2012 |
| WO | 2013/175983 | 11/2013 |
| WO | 2015/068714 | 5/2015 |
| WO | 2016/174071 | 11/2016 |
| WO | 2017/158139 | 9/2017 |

OTHER PUBLICATIONS

International Search Report dated Jul. 29, 2019 in International (PCT) Application No. PCT/AT2019/060155.
Chinese Search Report dated Nov. 19, 2021 in corresponding Chinese Patent Application No. 201980044564.6, 1 page.
Chinese Search Report dated Apr. 26, 2022 in corresponding Chinese Patent Application No. 201980044564.6, 1 page.

* cited by examiner

FURNITURE FITTING

BACKGROUND OF THE INVENTION

The present invention relates to a furniture fitting for supporting a furniture part movably-mounted relative to a furniture carcass. The furniture fitting includes a first fitting portion to be fixed to the furniture carcass, and a second fitting portion to be fixed to the movable furniture part, with the first fitting portion and the second fitting portion being hingedly connected or being configured to be releasably connected to one another. The first fitting portion includes at least one mounting body for fixing the first fitting portion to the furniture carcass, and a carrier, a position of which is configured to be adjusted relative to the mounting body. At least one actuating arm is pivotally arranged on the carrier, and a spring device is provided for applying a force to the at least one actuating arm. An adjustment device with three operating elements is provided, and a position of the carrier relative to the mounting body can be adjusted by each of the operating elements.

Moreover, the invention further concerns an item of furniture comprising a furniture carcass and a furniture part movably mounted relative to the furniture carcass by at least one furniture fitting of the type to be described.

FIG. 1 of WO 2017/158139 A1 shows a furniture hinge for pivotally supporting a door. A first fitting portion of the furniture hinge is countersunk in an elongated-shaped recess of a furniture panel of the furniture carcass. The second fitting portion of the furniture hinge is also received within an elongated-shaped recess of the movable furniture part. By adjustment means in the form of screws or eccentrics, the relative position of the second fitting portion relative to the first fitting portion can be adjusted. A drawback is the fact that the adjustment means are arranged on different fitting portions, so that the construction of the furniture fitting results relatively voluminous.

EP 2 853 667 A1, AT 388 016 B and EP 3 070 241 A1 disclose furniture hinges having a carcass-sided hinge arm, the position of which can be adjusted in a three-dimensional manner by three separate operating elements. In a mounted condition of the furniture hinges, the rotational axes of the operating elements are arranged perpendicular to the furniture panel to which the furniture hinges are fixed. For a person standing in front of the furniture carcass, in a mounted condition of the furniture hinges, the visibility and the accessibility of the operating elements is restricted.

SUMMARY OF THE INVENTION

It is an object of the present invention to propose a furniture fitting of the type mentioned in the introductory part, thereby avoiding the drawbacks as discussed above.

According to the invention, the mounting body includes a fastening side for fixing the mounting body to a, preferably substantially horizontally aligned, furniture panel of the furniture carcass, and a front side extending substantially perpendicular to the fastening side. Each of the operating elements is configured to be actuated from the front side of the mounting body, preferably with the aid of a tool.

In this way, all three operating elements, in a mounted condition of the furniture fitting, are immediately and directly accessible from the front (that is to say, from the front side extending perpendicular to the fastening side of the mounting body) for a manual or for a tool-assisted actuation.

The furniture fitting includes a carrier with an actuating arm arranged thereon, and a spring device for applying a force to the actuating arm. Each of the three operating elements of the adjustment device, upon an actuation, engages on that common carrier, whereby a position of the carrier relative to the mounting body to be fixed to the furniture carcass can be altered. In this way, an arrangement of the operating elements for the three-dimensional adjustment of the furniture part on different fitting portions can be omitted.

With an arrangement of the furniture fitting on a furniture panel, a position of the carrier relative to the mounting body can be adjusted by the first operating element in a lateral direction (that is to say in a plane parallel to a front face of the furniture panel and in the plane of the furniture panel). By a second operating element, a position of the carrier relative to the mounting body can be adjusted in a depth direction (that is to say in the plane of the furniture panel and in a direction extending transversely to the front face of the furniture panel). By a third operating element, a position of the carrier relative to the mounting body can be adjusted in a height direction (that is to say in a plane parallel to the front face of the furniture panel and substantially in a direction extending transversely to the plane of the furniture panel). The mounting body is arranged so as to be stationary relative to the furniture carcass upon an actuation of the operating elements.

According to an embodiment, at least two, preferably all three, operating elements are each rotationally supported about a rotational axis. Preferably, the rotational axes of the at least two, preferably three, operating elements extend substantially parallel to one another. In this way, a compact construction can be obtained on the one hand. On the other hand, the three operating elements can be altogether actuated from the same side for an adjustment with the aid of a tool, preferably a screwdriver.

With a constructionally simple embodiment, at least one operating element is in threading engagement with the mounting body.

At least one inclined surface portion for guiding the carrier can be arranged on the carrier and/or on the mounting body. The carrier, upon a rotation of an operating element about a rotational axis, is movably supported along the inclined surface portion in a direction extending transversely to the rotational axis. In this way, a very simple construction for deflecting a movement of the carrier in a direction extending transversely to the rotational axis of the operating element can be provided.

According to a further embodiment, the mounting body has a longitudinal extension and a height extension, and the longitudinal extension is at least three times, preferably at least six times, as large than the height extension of the mounting body. As a result, the furniture fitting can have a very compact construction, so that the mounting body is configured to be arranged within a predetermined material thickness of the furniture panel (for example having a material thickness of 16 mm or 19 mm).

The carrier can either have a one-piece configuration or also a two- or a multi-part configuration. Likewise, the mounting body can have a one-piece configuration or also a two- or a multi-part configuration.

According to an embodiment, the mounting body of the first fitting portion is configured to be inserted into a recess of the furniture panel. The mounting body, in a mounted condition on the furniture panel, is received for the most part, preferably substantially entirely, within the recess of the furniture panel. In this way, the mounting body can be arranged on the furniture carcass in a compact and visually unobtrusive manner.

The item of furniture according to the invention is characterized in that the item of furniture includes a furniture carcass having a furniture panel (for example a bottom panel, a top panel, a shelf arranged between the bottom panel and the top panel or a vertically extending sidewall), and the mounting body is supported on the furniture panel. Preferably, the mounting body, in a mounted position, is received for the most part within a recess of the furniture panel.

For example, the furniture fitting can be configured as a furniture hinge. However, it is also possible that the furniture fitting is configured as a furniture drive for moving a furniture flap, the furniture flap being pivotally supported about a horizontally extending axis in a mounted condition on the furniture carcass.

BRIEF DESCRIPTION OF THE DRAWINGS

Further details and advantages of the present invention will be explained with the aid of the exemplary embodiment shown in the drawings, in which.

DETAILED DESCRIPTION OF THE INVENTION

Figure 1A:
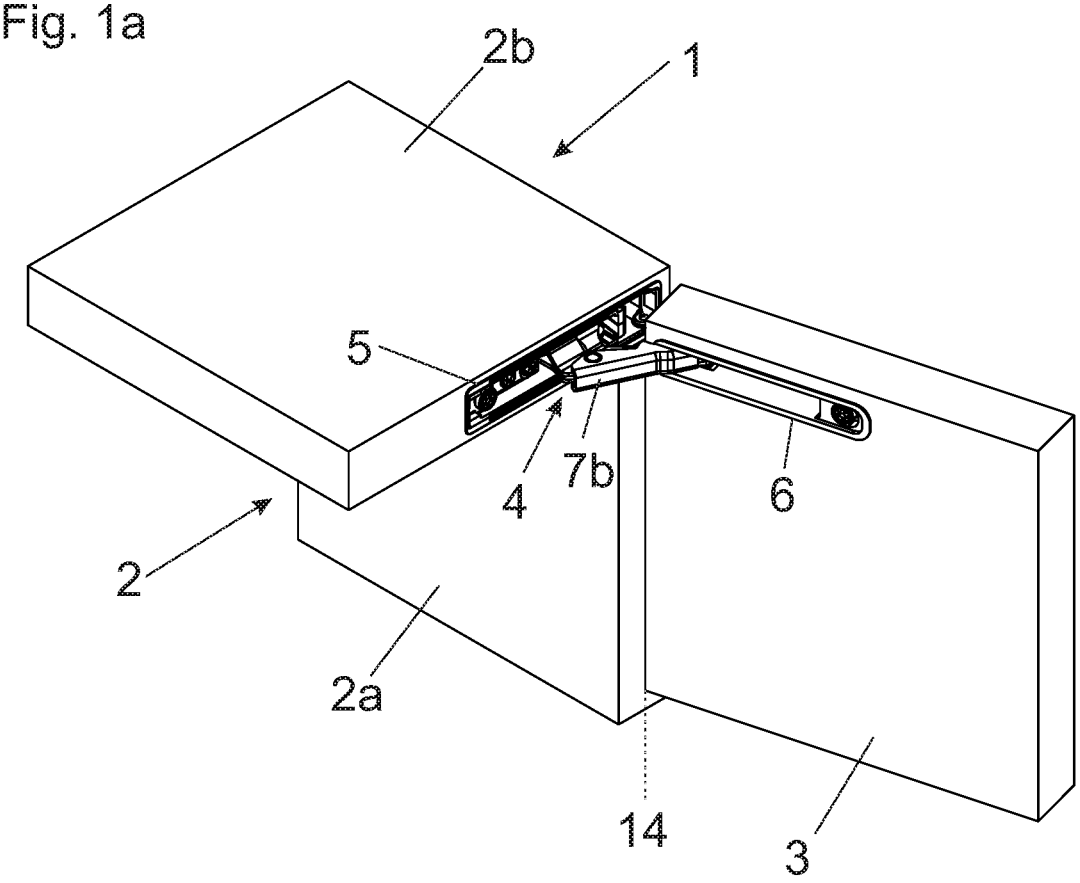
FIG. 1*a*, 1*b* show an item of furniture and a furniture fitting in perspective views.

FIG. 1*a* shows a perspective view of an item of furniture 1 with a furniture carcass 2 which is only partially depicted. A movable furniture part 3, preferably in the form of a door or a furniture flap, is pivotally supported about an axis 14 relative to the furniture carcass 2 by a furniture fitting 4, the axis 14 preferably extending vertically in a mounted position. The furniture carcass 2 includes a vertically extending furniture panel 2*a* in the form of a sidewall and a horizontally extending furniture panel 2*b* (preferably a top panel, a bottom panel or a shelf arranged between the top panel and the bottom panel). The first fitting portion 5 of the furniture fitting 4 is supported on or within the furniture panel 2*b*. Of course, it is also possible to fix the furniture fitting 4 to the vertically extending furniture panel 2*a*, so that the movable furniture part 3, in a mounted condition, is pivotally supported about a horizontally extending axis 14 relative to the furniture carcass 2.

In the shown embodiment, it is provided that the first fitting portion 5 is substantially entirely received within a first recess of the furniture panel 2*b*, whereas the second fitting portion 6 of the furniture fitting 4 is substantially entirely received within a second recess of the movable furniture part 3.

Figure 1B:
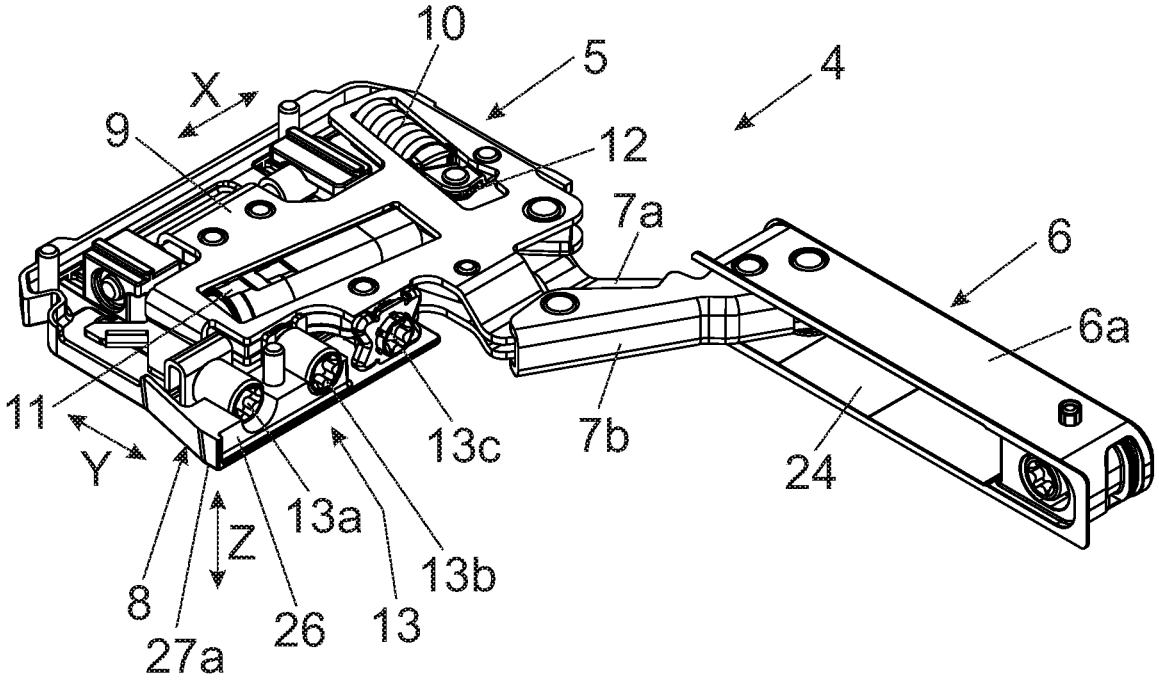

FIG. 1*b* shows the furniture fitting 4 in a perspective view. The first fitting portion 5 has at least a two-part configuration and includes a mounting body 8 configured to be fixed to the furniture carcass 2. The first fitting portion 5 further includes a carrier 9, and a position of the carrier 9 relative to the mounting body 8 can be adjusted by an adjustment device 13 having three operating elements 13*a*, 13*b*, 13*c*. At least one actuating arm 7*a*, 7*b* is pivotally supported on the carrier 9, and a spring device 10 is provided for applying a force to the at least one actuating arm 7*a*, 7*b*. The second fitting portion 6 is configured to be moved into the fully closed and/or fully open position relative to the first fitting portion 5 by a force of the spring device 10. This can be implemented, for example, by a pressure roller 12 pressurized by the spring device 10, the pressure roller 12 being configured to run along a setting contour 21 (FIG. 5) upon a movement of the actuating arm 7*a*. Preferably, the setting contour 21 is formed on the actuating arm 7*a*. By a damping device 11, preferably having a hydraulic piston-cylinder-unit, a movement of the second fitting portion 6 relative to the first fitting portion 5 can be decelerated. The carrier 9 is pivotally connected to the second fitting portion 6 via the actuating arms 7*a*, 7*b*, and the second fitting portion 6 is configured to be fixed to the movable furniture part 3 via a, preferably longitudinally extending, housing 6*a*.

In the shown embodiment, each of the operating elements 13*a*, 13*b*, 13*c* of the adjustment device 13 is rotationally supported about a rotational axis, and the rotational axes of the operating elements 13*a*, 13*b*, 13*c* extend substantially parallel to one another. Each of the operating elements 13*a*, 13*b*, 13*c* can have a receiving device for a tool, and a position of the carrier 9 relative to the mounting body 8 can be adjusted by an actuation of the operating elements 13*a*, 13*b*, 13*c* with the aid of the tool.

The mounting body 8 has at least one fastening side 27*a* for fixing the mounting body 8 to a, preferably substantially horizontally aligned, furniture panel 2*a*, 3*b* of the furniture carcass 2, and a front side 26 extending perpendicular to the fastening side 27. Each of the operating elements 13*a*, 13*b*, 13*c* is configured to be actuated from the front side 26 of the mounting body 8, preferably with the aid of a screwdriver. In a mounted condition of the mounting body 8 on the furniture panel 2*a*, 2*b*, only the front side 26 of the mounting body 8 is visible. The mounting body 8 is configured to be releasably locked with a housing or a holding plate configured to be pre-mounted to the furniture carcass 2, so that the mounting body 8 is configured to be coupled to the housing or to the holding plate pre-mounted to furniture carcass 2 without the use of a tool.

By the first operating element 13*a*, a position of the carrier 9 relative to the mounting body 8 can be adjusted in a lateral direction (X). By the second operating element 13*b*, a position of the carrier 9 relative to the mounting body 8 can be adjusted in a depth direction (Y). By the third operating element 13*c*, a position of the carrier 9 relative to the mounting body 8 can be adjusted in a height direction (H). In the shown embodiment, the first and second operating elements 13*a*, 13*b* are in threading engagement with the mounting body 8, whereas the third operating element 13*c* can include an eccentric for adjusting the carrier 9 in the height direction (Z).

Figure 2A:
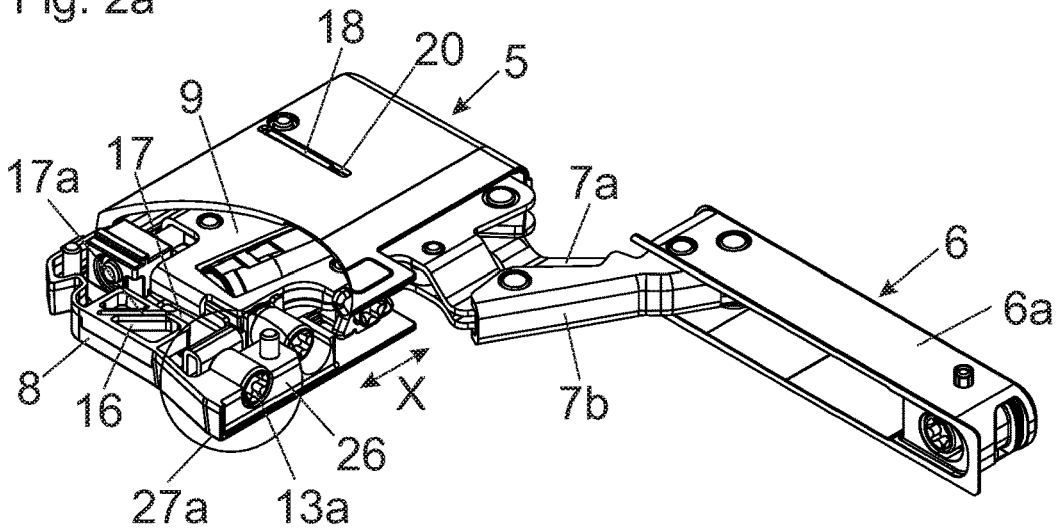
FIG. 2*a*-2*d* are two perspective views of the furniture fitting with different adjustment positions of the first operating element, and enlarged detail views thereof.
Figure 2B:
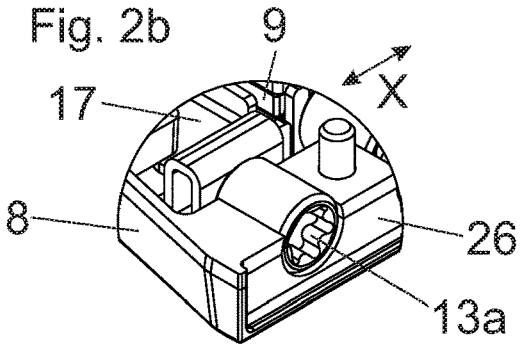
Figure 2C:
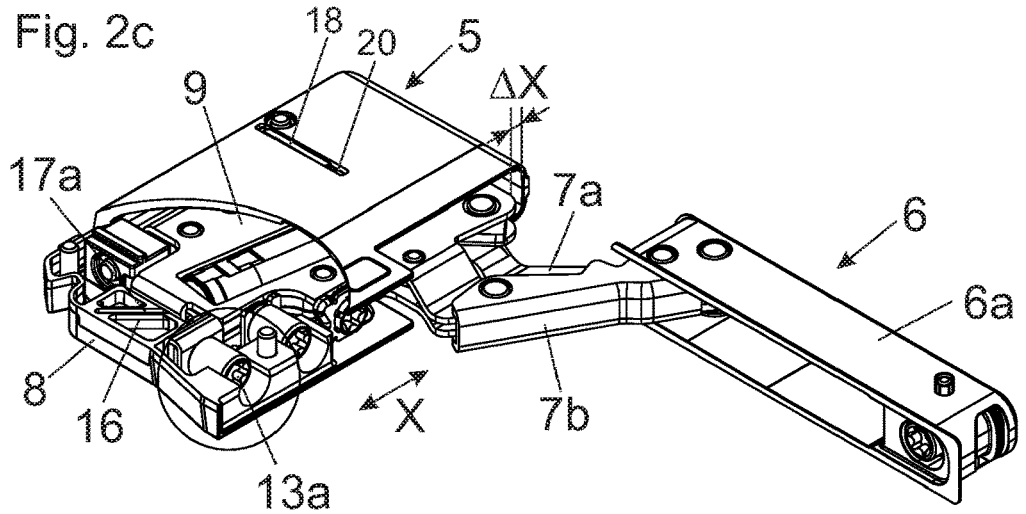
Figure 2D:
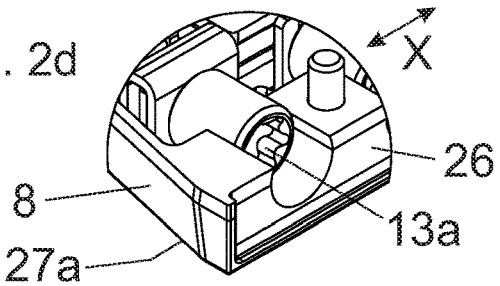
Figure 3A:
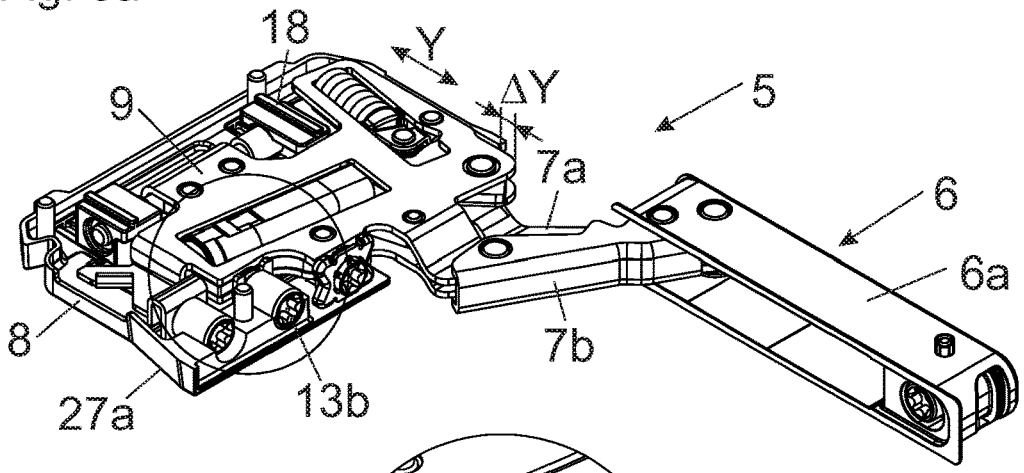
FIG. 3*a*-3*d* are two perspective views of the furniture fitting with different adjustment positions of the second operating element, and enlarged detail views thereof.
Figure 3B:
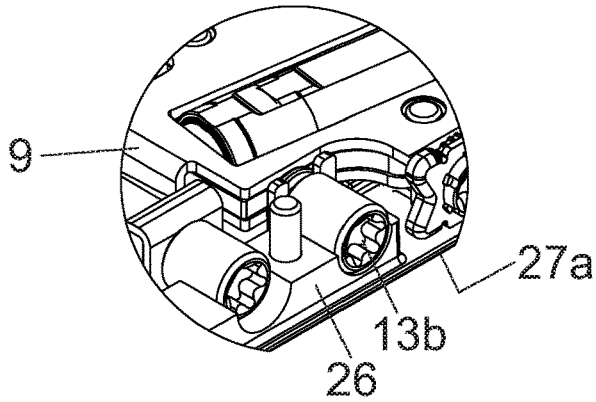
Figure 3C:
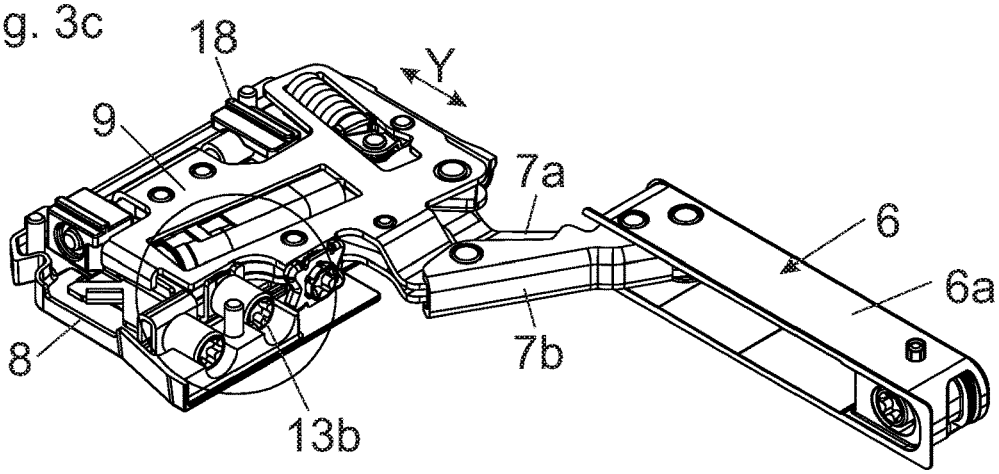
Figure 3D:
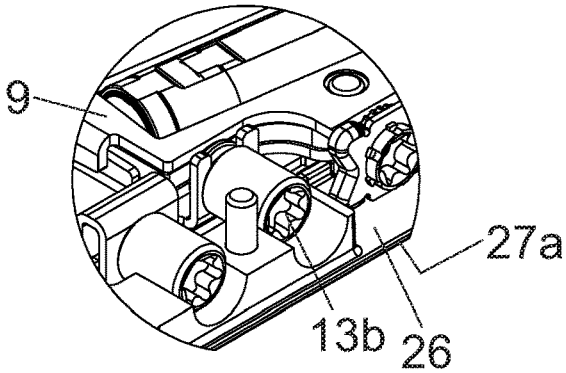

FIG. 2*a*-2*d* show the (partially broken-up) furniture fitting 4 in two different perspective views and two enlarged detail views thereof. The first operating element 13*a* is in threading engagement with the mounting body 8, and the carrier 9 can be adjusted relative to the mounting body 8 in a lateral direction (X) by a rotation of the first operating element 13*a*. For this purpose, an inclined surface portion 16 for guiding the carrier 9 is formed or arranged on the carrier 9 and/or on the mounting body 8. Moreover, a transmitting portion 17 having a guide element 17*a* in the form of an inclinedly extending tab is provided, the transmitting portion 17 being connected to the first operating element 13*a*. The guide element 17*a* (and therewith the carrier 9), upon a rotation of the first operating element 13*a* about a rotational axis, is movably supported along the inclined surface portion 16 in a direction (X) extending transversely to the rotational axis. When the first operating element 13*a*, from the position shown in FIG. 2*a*, is rotated in a clockwise direction by an actuation with the aid of a tool, the carrier 9 can be displaced by the difference amount (ΔX) in the lateral direction (X) (FIG. 2*c*). FIG. 2*d* shows the encircled region of FIG. 2*c* in an enlarged view.

FIG. 3*a*-3*d* shows two perspective views of the furniture fitting 4 with different adjustment positions of the second operating element 13*b*, and enlarged detail views thereof. By an actuation of the second operating element 13*b*, a position of the carrier 9 relative to the mounting body 8 can be adjusted in a depth direction (Y). The second operating element 13*b* is in threading engagement with the mounting body 8 and engages the carrier 9, so that the carrier 9 can be adjusted by the difference amount (ΔY) in the depth direction (Y) upon a rotation of the second operating element 13*b*. For an improved linear guidance of the carrier 9, a guide rib 18 may be provided on the carrier 9, the guide rib 18 extending at least over a region the depth direction (Y). The guide rib 18 of the carrier 9 is displaceably guided in a recess 20 of the mounting body 8 (FIG. 2*a*, FIG. 2*b*), the recess 20 extending in the depth direction (Y).

Figure 4A:
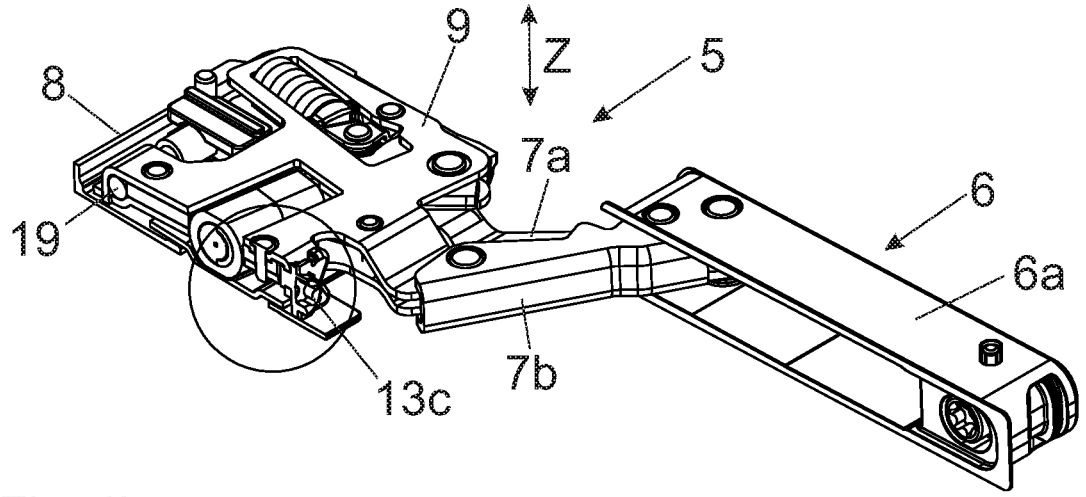
FIG. 4*a*-4*d* are different views of the furniture fitting with different adjustment positions of the third operating element.
Figure 4B:
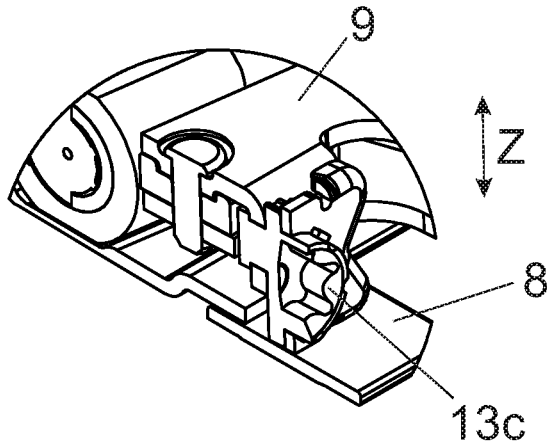
Figure 4C:
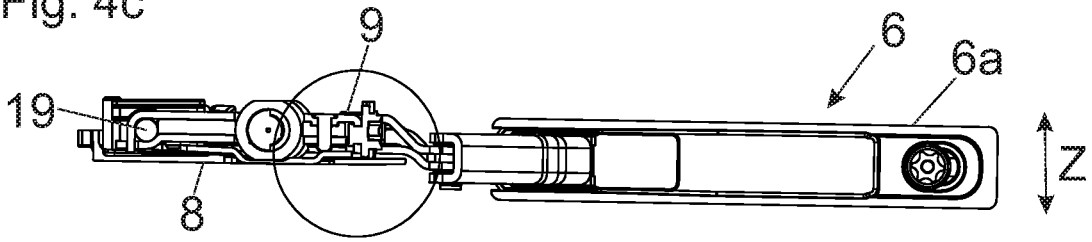
Figure 4D:
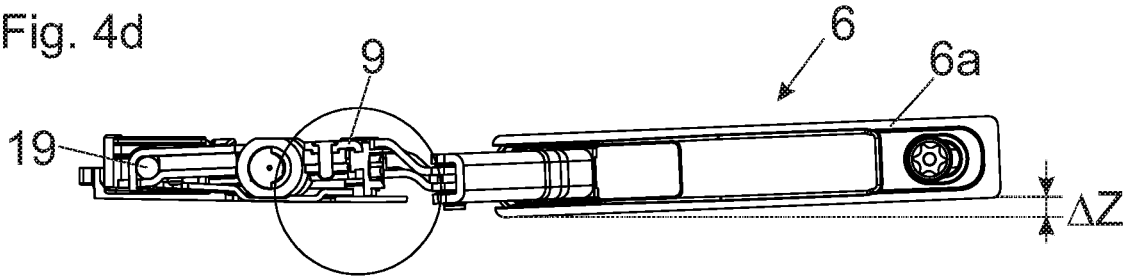

FIG. 4*a* shows a perspective, cross-sectional view of the furniture fitting 4, so that the third operating element 13*c* is visible. The third operating element 13*c* includes an eccentric, the eccentric being rotationally arranged on the carrier 9 and being configured to be supported on the mounting body 8. The carrier 9 is tiltably supported about the hinge axis 19, and the carrier 9 is movable in the height direction (Z) upon a rotation of the third operating element 13*c* about the hinge axis 19. FIG. 4*b* shows the encircled region of FIG. 4*a* in an enlarged view. FIG. 4*c* and FIG. 4*d* each show a cross-sectional view of the furniture fitting 4 with different adjustment positions of the third operating element 13*c*. Upon a rotation of the third operating element 13*c*, a position of the carrier 9 relative to the mounting body 8 can be adjusted, so that the position of the second fitting portion 6 can be adjusted in the height direction (Z) by the difference amount (AZ).

Figure 5:
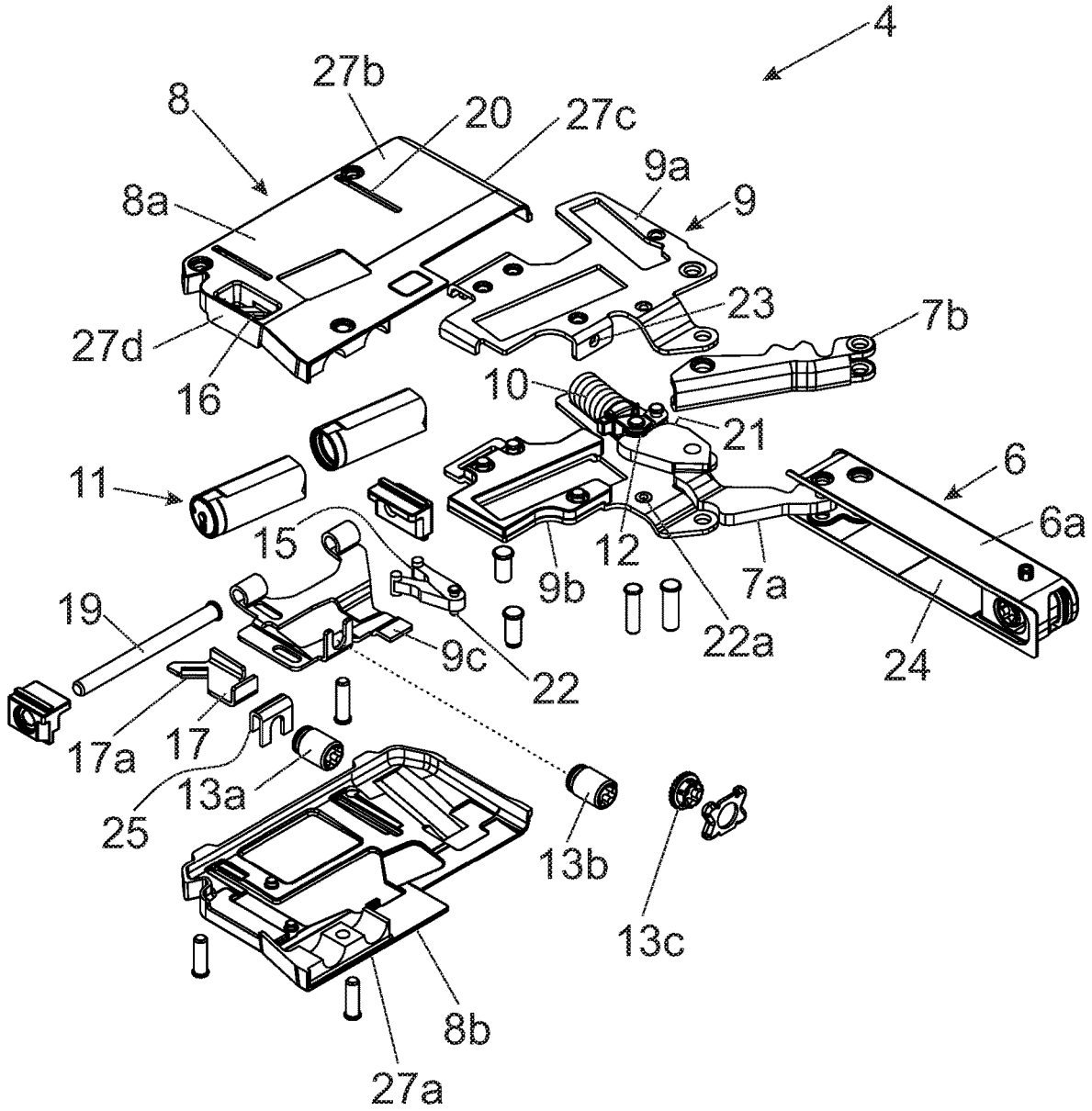
FIG. 5 shows the furniture fitting in an exploded view.

FIG. 5 shows the furniture fitting 4 in an exploded view. The mounting body 8, in the shown embodiment, has a two-part configuration and includes two portions 8*a* and 8*b* which jointly form a, preferably pocket-shaped, housing for receiving the carrier 9. The inclined surface portion 16 is arranged on the first portion 8*a* of the mounting body 8, the inclined surface portion 16 being provided for guiding the guide element 17*a* of the transmitting portion 17. The first operating element 13*a* is coupled to the transmitting portion 17 via a holder 25.

On the first portion 8*a* of the mounting body 8, the fastening side 27*a* for bearing the mounting body 8 against a, preferably substantially horizontally aligned, furniture panel 2*a*, 2*b* of the furniture carcass 2 and the front side 26 extending perpendicular to the fastening side 27*a* are arranged. According to an embodiment, it can be provided that the rotational axes of the operating elements 13*a*, 13*b*, 13*c* extend substantially perpendicular to the front side 26 of the mounting body 8. On the second portion 8*b* of the mounting body 8, further fastening sides 27*b*, 27*c*, 27*d* can be arranged or formed for fixing the mounting body 8 to one of the furniture panels 2*a*, 2*b* in an alternative way. The fastening sides 27*a*, 27*b*, 27*c* and/or the front side 26 of the mounting body 8 is or are configured so as to be flat at least over a region.

In the shown embodiment, the carrier 9 has a multi-part configuration and includes a first carrier portion 9*a*, a second carrier portion 9*b* and a third carrier portion 9*c*. A bearing 23 for receiving the third operating element 13*c* is arranged on the first carrier portion 9*a*. The third operating element 13*c*, on a peripheral surface, has a plurality of latches for positioning the third operating element 13*c* in a plurality of predetermined rotational positions. Upon a rotation of the third operating element 13*c*, the third carrier portion 9*c* is configured to be tilted about the hinge axis 19, so that the carrier 9 is movable relative to the mounting body 8 in the height direction (Z).

The spring device 10 for applying a force to the actuating arm 7*a* is arranged on the second carrier portion 9*b*, and a pressure roller 12 pressurized by the spring device 10 is configured to run along a setting contour 21 upon a movement of the actuating arm 7*a*. The setting contour 21 may be formed or arranged, for example, on the actuating arm 7*a*, and the actuating arm 7*a* is hingedly connected to the housing 6*a* of the second fitting portion 6.

The second operating element 13*b* engages the third carrier portion 9*c* of the carrier 9, so that the carrier 9 can be adjusted relative to the mounting body 8 in the depth direction (Y).

By a damping device 11, preferably with a hydraulic piston-cylinder-unit or, alternatively, a rotational damper, a movement of the at least one actuating arm 7*a* into the closed end position and/or in the opened end position can be decelerated, and the closed end position and the opened end position correspond with the respective end positions of the movable furniture part 3 relative to the furniture carcass 2. For pressurizing the damping device 11, a control portion 15 is provided, the control portion 15 being pivotally mounted about a hinge axis member 22. In a mounted position, the hinge axis member 22 of the control portion 15 engages into a bore 22*a* arranged on the second carrier portion 9*b*. The control portion 15 has two lever arms, and a first lever arm of the control portion 15 is configured to be pressurized by the actuating arm 7*a* upon a closing movement of the furniture fitting 4. The second lever arm of the control portion 15 introduces a force into the damping device 11 for performing a damping hub. The second fitting portion 6 includes a cavity 24 in which the actuating arms 7*a*, 7*b*, in the closed position of the furniture fitting 4, can be at least partially accommodated.

The invention claimed is:

1. A furniture fitting for supporting a furniture part movably-mounted relative to a furniture carcass, the furniture fitting comprising:

a first fitting portion to be fixed to the furniture carcass; and a second fitting portion to be fixed to the movable furniture part, the first fitting portion and the second fitting portion being hingedly connected to one another, wherein the first fitting portion includes a mounting body for fixing the first fitting portion to the furniture carcass, a carrier, a position of the carrier being configured to be adjusted relative to the mounting body, wherein an actuating arm is pivotally arranged on the carrier, a spring device for applying a force to the actuating arm, and an adjustment device with three operating elements arranged on the mounting body and configured such that the position of the carrier relative to the mounting body is adjustable by each of the three operating elements, wherein the mounting body includes a fastening side for fixing the mounting body to a furniture panel of the furniture carcass, and a front side extending perpendicular to the fastening side, wherein each of the three operating elements is configured to be actuated from the front side of the mounting body, wherein a position of the carrier relative to the mounting body is adjustable in a lateral direction by a first one of the three operating elements, a position of the carrier relative to the mounting body is adjustable in a depth direction by a second one of the three operating elements, and a position of the carrier relative to the mounting body is adjustable in a height direction by a third one of the operating elements, wherein an inclined surface portion is arranged on the mounting body, wherein a transmitting portion is connected to the first one of the three operating elements and is movably supported along the inclined surface portion, and wherein the carrier and the transmitting portion are configured such that, upon a rotation of the first one of the operating elements about a rotational axis, the transmitting portion moves along the inclined surface portion so as to move the carrier in a direction extending transversely to the rotational axis.

2. The furniture fitting according to claim 1, wherein the mounting body, upon an actuation of the three operating elements, is arranged so as to be stationary relative to the furniture carcass.

3. The furniture fitting according to claim 1, wherein at least two of the three operating elements are each rotatably supported about a respective rotational axis.

4. The furniture fitting according to claim 1, wherein the three operating elements are each rotatably supported about a respective rotational axis, and wherein the respective rotational axes of the three operating elements extend substantially parallel to one another.

5. The furniture fitting according to claim 1, wherein at least one of the three operating elements is in threading engagement with the mounting body.

6. The furniture fitting according to claim 1, wherein the front side of the mounting body, in a closed condition of the furniture fitting, faces towards the second fitting portion and, in a mounted condition of the furniture fitting, is aligned substantially parallel to a front face of the furniture carcass.

7. The furniture fitting according to claim 1, wherein the mounting body has a longitudinal extension and a height extension, and wherein the longitudinal extension of the mounting body is at least three times larger than the height extension of the mounting body.

8. The furniture fitting according to claim 1, wherein the mounting body is configured to be received within a recess of the furniture panel, and wherein in a mounted condition of the furniture fitting on the furniture panel, only the front side of the mounting body is visible.

9. The furniture fitting according to claim 1, wherein a setting contour is provided, and wherein a pressure roller pressurized by the spring device is configured to run along the setting contour upon a movement of the actuating arm.

10. The furniture fitting according to claim 1, wherein the furniture fitting includes at least one damping device for dampening a movement of the pivotally mounted actuating arm.

11. The furniture fitting according to claim 1, wherein the furniture fitting is configured as a furniture hinge.

12. The furniture fitting according to claim 1, wherein at least one of the fastening side and the front side of the mounting body is configured to include a flat region.

13. An item of furniture comprising a furniture carcass and at least one furniture part which is movably supported relative to the furniture carcass by the furniture fitting according to claim 1.

14. The furniture fitting according to claim 1, wherein the fastening side is configured for fixing the mounting body to a substantially horizontally aligned furniture panel of the furniture carcass.

15. The furniture fitting according to claim 1, wherein each of the three operating elements is configured to be actuated from the front side of the mounting body with the aid of a tool.

16. The furniture fitting according to claim 3, wherein the respective rotational axes of the at least two operating elements extend substantially parallel to one another.

17. The furniture fitting according to claim 7, wherein the longitudinal extension of the mounting body is at least six times larger than the height extension of the mounting body.

18. The furniture fitting according to claim 9, wherein the setting contour is arranged on the actuating arm.

* * * * *